US005564370A

United States Patent [19]

Giraud et al.

[11] Patent Number: 5,564,370

[45] Date of Patent: Oct. 15, 1996

[54] STEAM GENERATOR WITH DETACHABLE CYCLONE SEPARATORS

[75] Inventors: Benoît Giraud, Lyon; Christophe Poussin, Caluire, both of France

[73] Assignee: Framatome, Courbevoie, France

[21] Appl. No.: 274,135

[22] Filed: Jul. 12, 1994

[30] Foreign Application Priority Data

Jul. 12, 1993 [FR] France ..... 93 08559

[51] Int. Cl.[6] ..... F22B 1/02

[52] U.S. Cl. ..... 122/34; 122/491; 122/492

[58] Field of Search ..... 122/34, 491, 492

[56] References Cited

U.S. PATENT DOCUMENTS

| | | | |
|---|---|---|---|
| 3,894,517 | 7/1975 | Meier | 122/34 |
| 4,208,987 | 6/1980 | Chaix et al. | 122/34 |
| 4,344,387 | 8/1982 | Yazidjian . | |
| 4,783,204 | 11/1988 | Roarty . | |

FOREIGN PATENT DOCUMENTS

| | | | |
|---|---|---|---|
| 1227128 | 4/1971 | United Kingdom . | |
| 1233347 | 5/1971 | United Kingdom . | |
| 2064734 | 6/1981 | United Kingdom | 34/122 |

OTHER PUBLICATIONS

Search Report FR 93 08559.

*Primary Examiner*—Henry Bennett
*Assistant Examiner*—Siddharth Ohri
*Attorney, Agent, or Firm*—Pollock, Vande Sande & Priddy

[57] ABSTRACT

Recirculation-type steam generator ensuring heat transfer between a fluid circulating in a primary circuit and a fluid circulating in a secondary circuit, constituted by a pressure envelope containing a vaporization enclosure having a roof and covering a bundle of tubes traversed by the primary fluid. The generator receives the secondary fluid which circulates in the vaporization enclosure. The steam produced by the secondary fluid is extracted during this circulation and is dried by cyclone separators constituted by cyclones fixed to first ends of tubular columns whose ends are fixed to the vaporization enclosure roof communicating with the vaporization enclosure. The cyclone separators are detachably fixed to the vaporization enclosure roof.

7 Claims, 5 Drawing Sheets

STEAM GENERATOR WITH DETACHABLE CYCLONE SEPARATORS

FIELD OF THE INVENTION

The present invention relates to a steam generator or boiler having detachable cyclone separators of the recirculation type and used in nuclear power stations.

BACKGROUND OF THE INVENTION

In a pressurized water nuclear reactor, the hot water passing out of the reactor (primary circuit water) is fed into a heat exchanger, the steam generator, where it transfers its heat to another water circuit (secondary circuit) without any direct contact with the water of the reactor. The secondary circuit water vaporizes during the heat exchange and supplies a turbine.

Such a steam generator is generally constituted by an outer, pressure-resistant envelope of considerable height, within which is placed a secondary (vaporization) enclosure covering a bundle of tubes traversed by the pressurized primary water. The secondary circuit is supplied with water in the steam generator, normally in the upper part of the latter. This feed water flows towards the bottom of the steam generator, outside the vaporization enclosure, before entering the latter by its lower part so as to come into contact with the tube bundle and be vaporized.

A mixture of water and steam, which becomes ever richer in steam, flows within the vaporization enclosure in the upward direction and passes out through the upper part of the enclosure into the generator steam dome, which is located between the upper part of the vaporization enclosure and the upper part of the outer envelope.

The steam dome is provided with devices for separating the water and the steam, enabling the steam to be dried before it passes out of the generator. These devices normally comprise a first stage located at the outlet of the vaporization enclosure and constituted by cyclone separators where a large part of the water is eliminated by centrifuging. It also comprises a second stage positioned above the first and formed e.g. by herringbone plates.

The cyclone separators are spiral deflector cylindrical tubes fixed to the ends of tubular columns, which are in turn fixed to the roof of the vaporization enclosure and which communicate with the latter. The mixture of water and steam from the vaporization enclosure thus transits the tubular columns before undergoing a first separation in the cyclone separators. In normal operation, the tubular columns are partly immersed in secondary water.

In order to increase the performance characteristics of the separator and better utilize the volume available in the steam dome, it is advantageous to use small diameter cyclone separators. This reduction in the diameter of the cyclones is, however, accompanied by an increase in their number. For example, for a steam generator with a heating power of 1000 MW operating at 75 bars, it is necessary to have 120 to 140 200 mm diameter separators. Moreover for motor load considerations in the recirculation loop or water reserve in the steam generators, it may be necessary to fix the free level of the secondary water in the steam dome at approximately 2 or 3 meters above the bundle of tubes. As the cyclones must be positioned above this level, the tubular columns linking the cyclones with the vaporization enclosure roof must have a considerable height.

Cyclone separators, no matter whether each is formed by a cyclone fixed to the end of a tubular column welded to the roof of the vaporization enclosure or several cyclones fixed to the end of a larger diameter tubular column fixed to the enclosure roof (CF. FR-A-2 480 905), present maintenance problems in as much as such a group of separators does not permit easy access to the different cyclones for repair or inspection purposes.

SUMMARY OF THE INVENTION

The invention aims at obviating this disadvantage by proposing detachable cyclone separators, permits the installation of a large trap door in order to give access to the bent portion of the tubes in the bundle.

The invention therefore relates to a recirculation-type steam generator ensuring heat transfer between a fluid circulating in a primary circuit and a fluid circulating in a secondary circuit, constituted by a pressure envelope containing a vaporization enclosure having a roof and covering a bundle of tubes traversed by the primary fluid. The generator comprises means permitting the introduction of the secondary fluid, its circulation within the vaporization enclosure and the extraction of the steam produced by the secondary fluid during this circulation, and drying means for the steam located between the vaporization enclosure roof and the steam extraction means. The drying means incorporate cyclone separators constituted by cyclones fixed to first ends of the tubular columns, the second ends of which are fixed to the vaporization enclosure roof communicating with the vaporization enclosure. The cyclone separators are detachably fixed to the roof of the vaporization enclosure.

Each tubular column advantageously comprises a base integral with the roof of the vaporization enclosure and a spacer tube fixed by one of its ends and in detachable manner to the base, the other end of the spacer tube being fixed to at least one cyclone. The base can have a very limited length and can even be reduced to a flange integral with the roof of the envelope of the bundle.

Preferably, the cyclones are detachably fixed to the tubular columns. The detachable fastenings can be in the form of clamps, which permit rapid assembly and disassembly.

The steam generator can have means for separating the cyclone separators, the supporting means being fixed to the vaporization enclosure roof. The supporting means and the cyclone separators can have complementary elements permitting guidance of the cyclone separators during their installation. They can comprise a reception mast for a handling tool for the separators.

The roof of the vaporization enclosure is advantageously provided with a trap door permitting the passage of personnel.

BRIEF DESCRIPTION OF THE DRAWING

The invention will now be described in greater detail relative to an embodiment and with reference to the attached drawings, wherein show.

DETAILED DESCRIPTION

Figure 1:
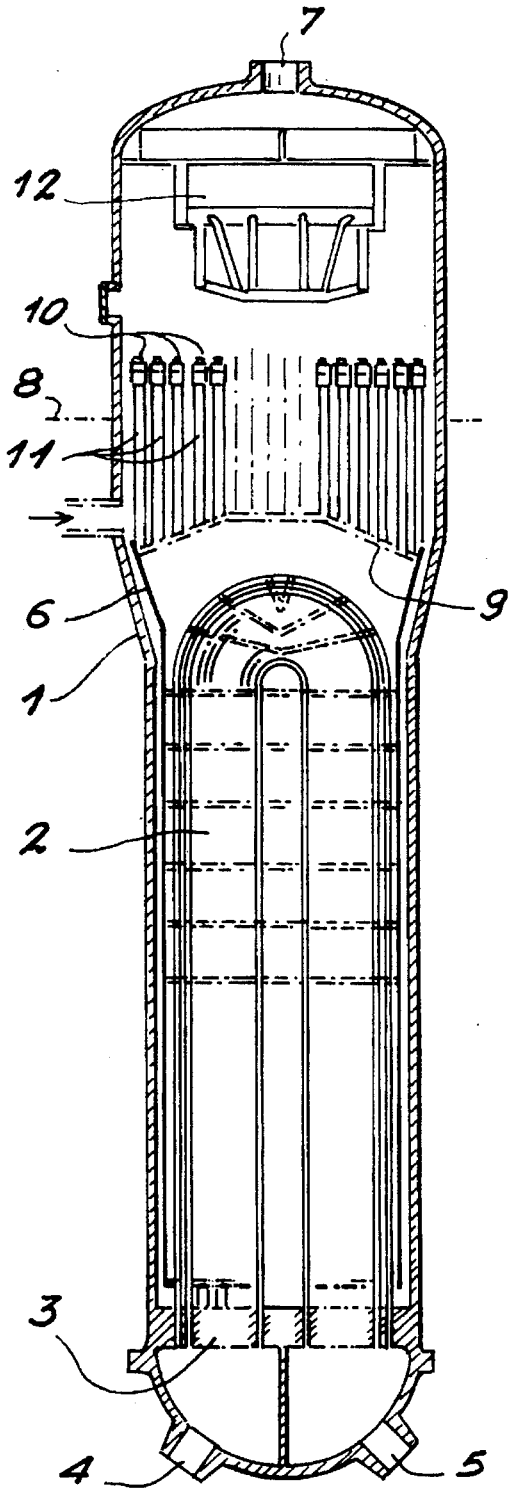
FIG. 1 is a vertical sectional view of a prior art steam generator.

FIG. 1, shows a steam generator or boiler, whose outer, pressure-resisting envelope 1 contains in its smaller diameter lower part a tube bundle 2 comprising a plurality of inverted U-shaped bent tubes. These tubes are traversed by the pressurized water forming part of the primary circuit and introduced into the steam generator beneath the tube sheet 3 by an intake opening 4. The pressurized water traverses the tubes of the tube bundle 2 and then returns under the tube sheet 3 to pass out through the outlet opening 5.

The tube bundle 2 is surrounded, up to the vicinity of its lower portion, by a secondary envelope 6 constituting the vaporization enclosure within which the mixture of secondary water and feed water is in contact with the tube bundle 2, traversed by the high temperature water from the reactor core which vaporizes progressively on rising within the enclosure 6. The highest part of the steam dome is provided with an opening 7 for the discharge of steam to the turbine.

Feed water supply device not shown makes it possible to maintain the secondary water level 8 in the steam generator a certain distance above the tube bundle 2 and below cyclones 10 communicating with the top of the vaporization enclosure 6 by means of tubular columns 11. These tubular columns are welded to the roof 9 of the vaporization enclosure 6 and permit communication with the interior of the enclosure. A mixture of secondary water and feed water first passes into the space between the outer envelope 1 and the enclosure 6 so as to reach the lower end of the enclosure.

At the outlet from the cyclones 10, the steam, which has given up most of the entrained water, passes into the secondary separators 12 constituted by baffles permitting a more complete drying of the steam prior to its discharge through the opening 7.

FIG. 1 clearly shows that there is poor access to the tubular columns 11, a large number of which are arranged in juxtaposed manner, and consequently the assembly, maintenance and repair of these columns are relatively difficult. In the same way, the construction of this part of the steam generator involves a large number of fitting and fixing operations by welding.

Figure 2:
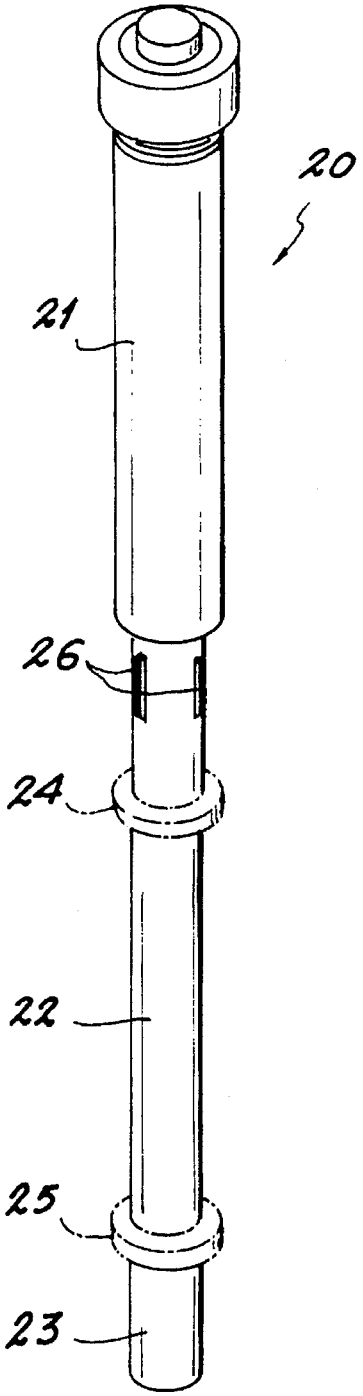
FIG. 2 is a perspective view of a cyclone separator considered in isolation and according to the invention.

The cyclone separator 20 in FIG. 2 comprises a cyclone 21, a spacer tube 22 and a base 23. Clamps 24, 25 ensure the detachable fixing respectively between the cyclone 21 and the spacer tube 22 on the one hand and the spacer tube 22 to the tubular base 23. Four pins 26 are welded to the lower part of the body of the cyclone 21 and arranged at 90° from one another with respect to the cyclone axis.

Figure 3:
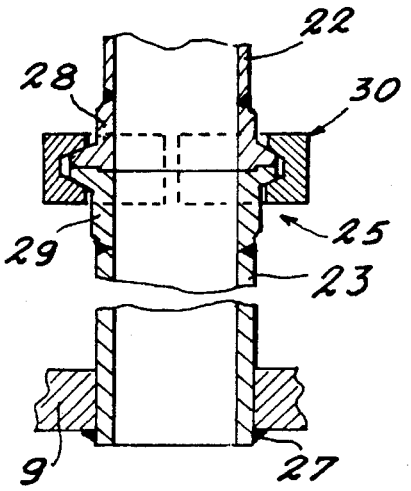
FIG. 3 shows a detachable fastening for the cyclone separator according to the invention.

FIG. 3 shows in section the lower part of the tubular column connecting a cyclone to the vaporization enclosure roof 9. It is possible to see the tubular base 23 entering the roof 9 and welded to the latter by a weld seam 27 on the inside of the vaporization enclosure. The base 23 is detachably fixed to the spacer tube 22 by the clamp 25. This clamp can be a detachable connection of the type marketed under the trademark CEFILAC. It is then constituted by two end fittings 28, 29, respectively welded to the spacer tube 22 and to the base 23, of a joint and an articulated collar given the common reference numeral 30.

Figure 4:
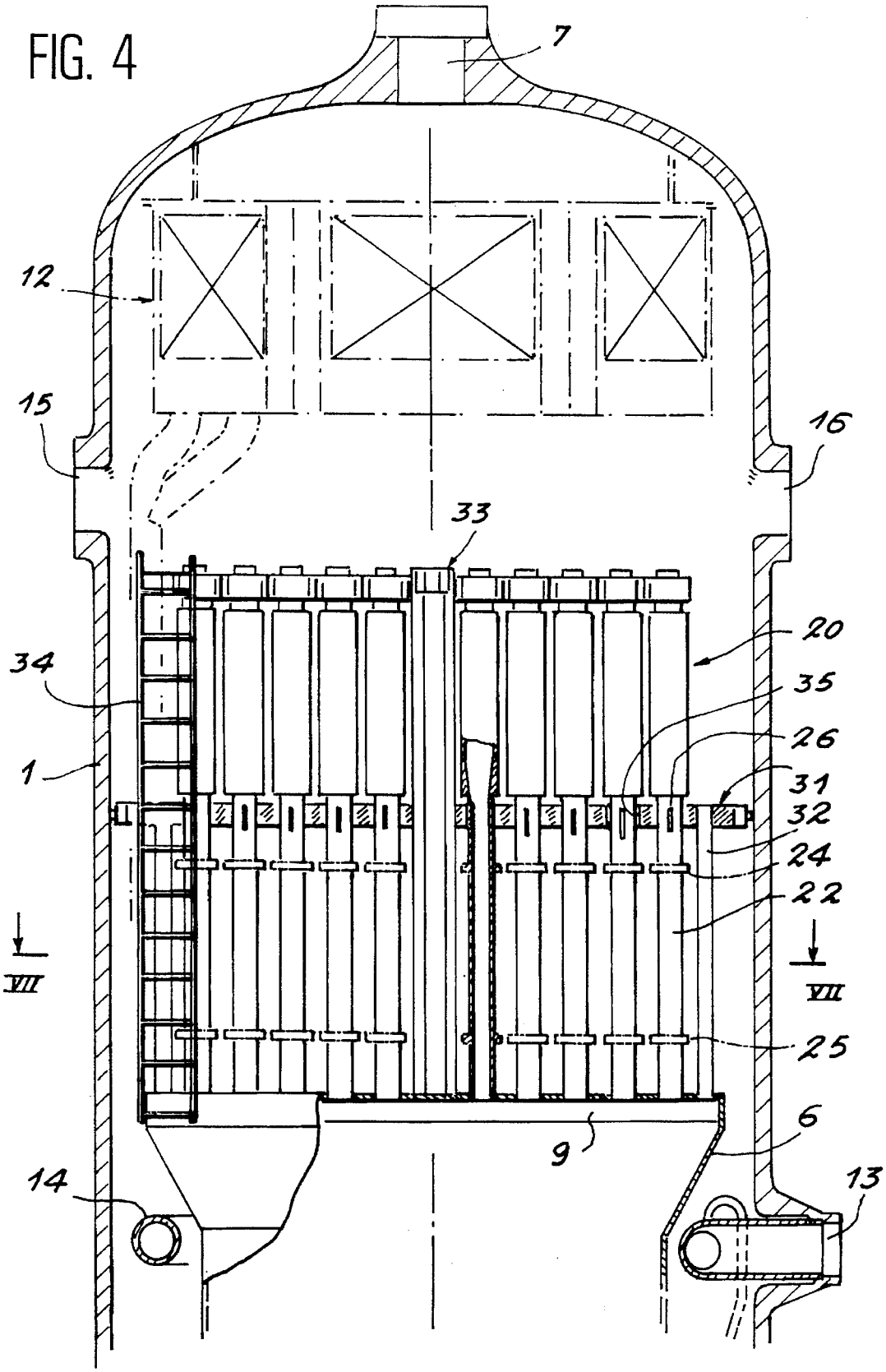
FIG. 4 is a vertical sectional view of the upper part of a steam generator according to the invention.

FIG. 4 clearly shows the cyclone separators 20 installed on the roof 9 of the vaporization enclosure 6. It is possible to see the intake 13 for the feed water and to which is connected the supply ring 14. Two manholes 15, 16 in the outer envelope 1 permit the passage of personnel into the area located between the two water - steam separating devices.

In order to permit a good maintance of the cyclone separators 20, which are several meters high, a supporting structure is provided which incorporates a grating 31, which is itself kept at a certain distance from the roof 9 by posts 32 integral with the roof. As shown in FIG. 4, the support grating 31 is located in the lower part of the cyclones, level with the pins 26. This supporting structure can also incorporate a central mast 33 and ladders 34 enabling a person entering one of manholes 15 or 16 to descend down to the support grating 31 and to the vaporization enclosure roof 9.

Figure 5:
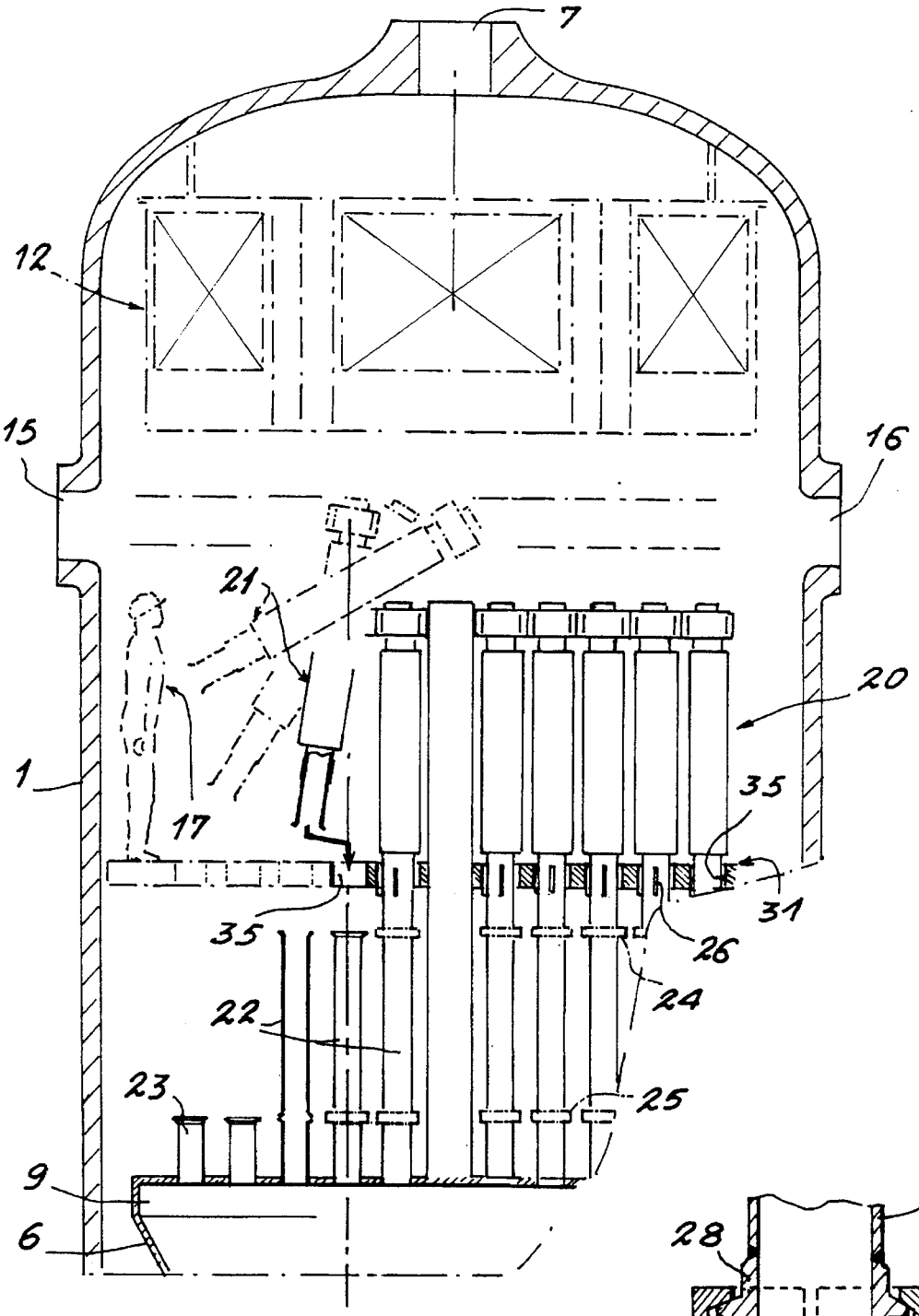
FIG. 5 is a view similar to FIG. 4, but during a cyclone separator assembly or disassembly operation.

FIG. 5 illustrates an assembly or disassembly operation with respect to the cyclone separators after the partial or total emptying of the outer envelope 1. Loosening of the upper clamp 24 just below the support grating 31 makes it possible for the operator 17 on the grating to remove a cyclone 21 by means of a handling tool carried by the central mast. On dropping down to the vaporization enclosure roof 9, the operator is able to loosen the lower clamp 25 and remove the spacer tube 22.

Figure 6:
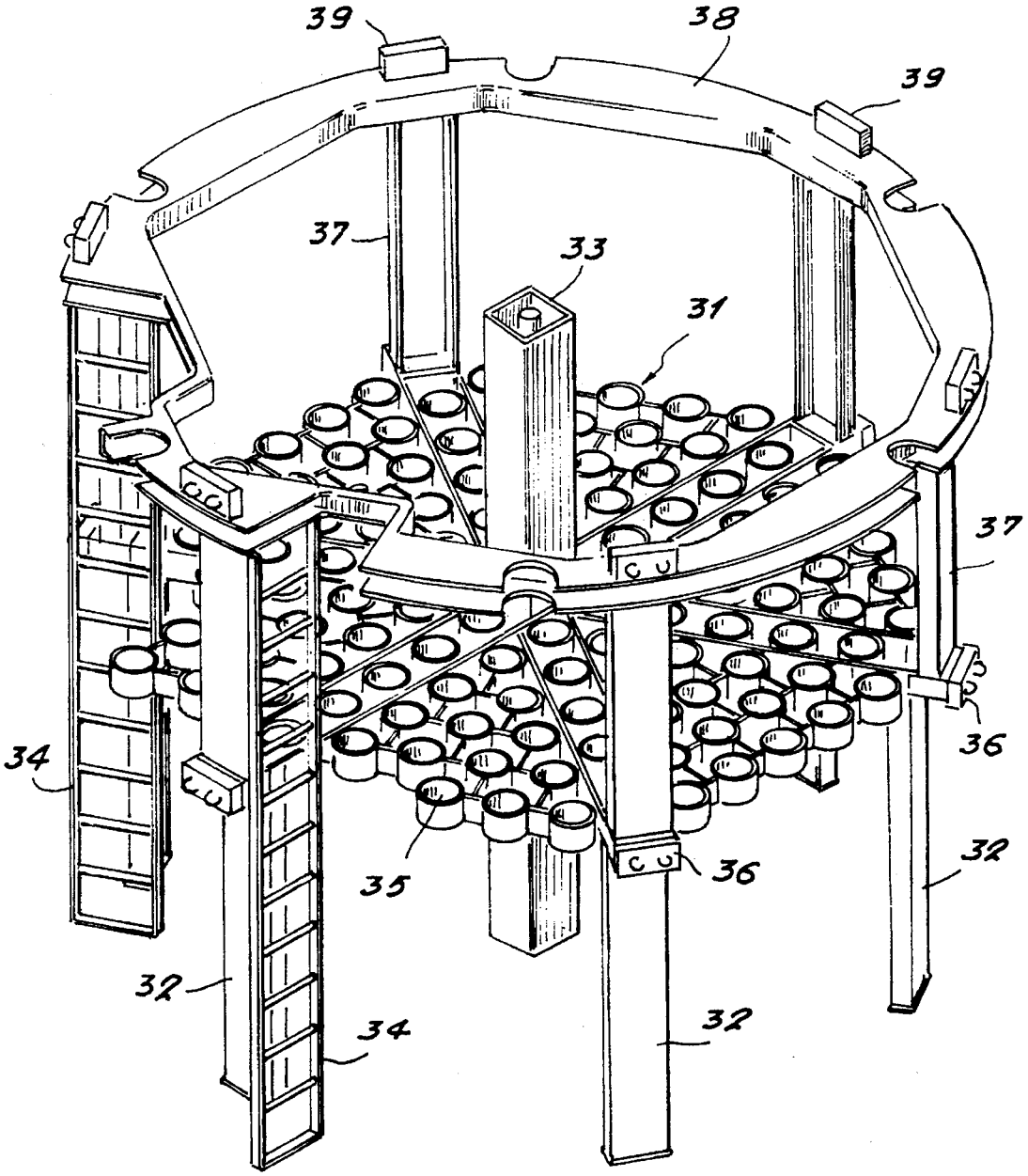
FIG. 6 is a perspective view of a supporting structure for cyclone separators used in the steam generator according to the invention.

FIG. 6 shows the complete supporting structure. It is possible to see the elements already described, namely, the grating 31, the posts 32, the central mast 33 and the ladders 34. The support grating 31 has a honeycomb structure constituted by cavities 35 for receiving lower parts of cyclones, the cavities being mechanically interconnected to form the grating 31. Pins 26 (CF. FIG. 4) permit the centering of the cyclone separators in the cavities.

Abutments 36, facing the outside of the supporting structure, radially maintain the structure in the outer envelope of the steam generator.

The grating 31 also supports upper posts 37, placed approximately in alignment with lower posts 32 and fixed to a ring 38. The ring is positioned below the level of the manholes 15 and 16 (CF. FIG. 4) and permits the fixing of ladders 34 and the possible positioning of floors allowing the movement of an operator for inspecting the heads of the cyclone separator. It also supports abutments 39 for radially maintaining the structure in the outer envelope of the steam generator.

Figure 7:
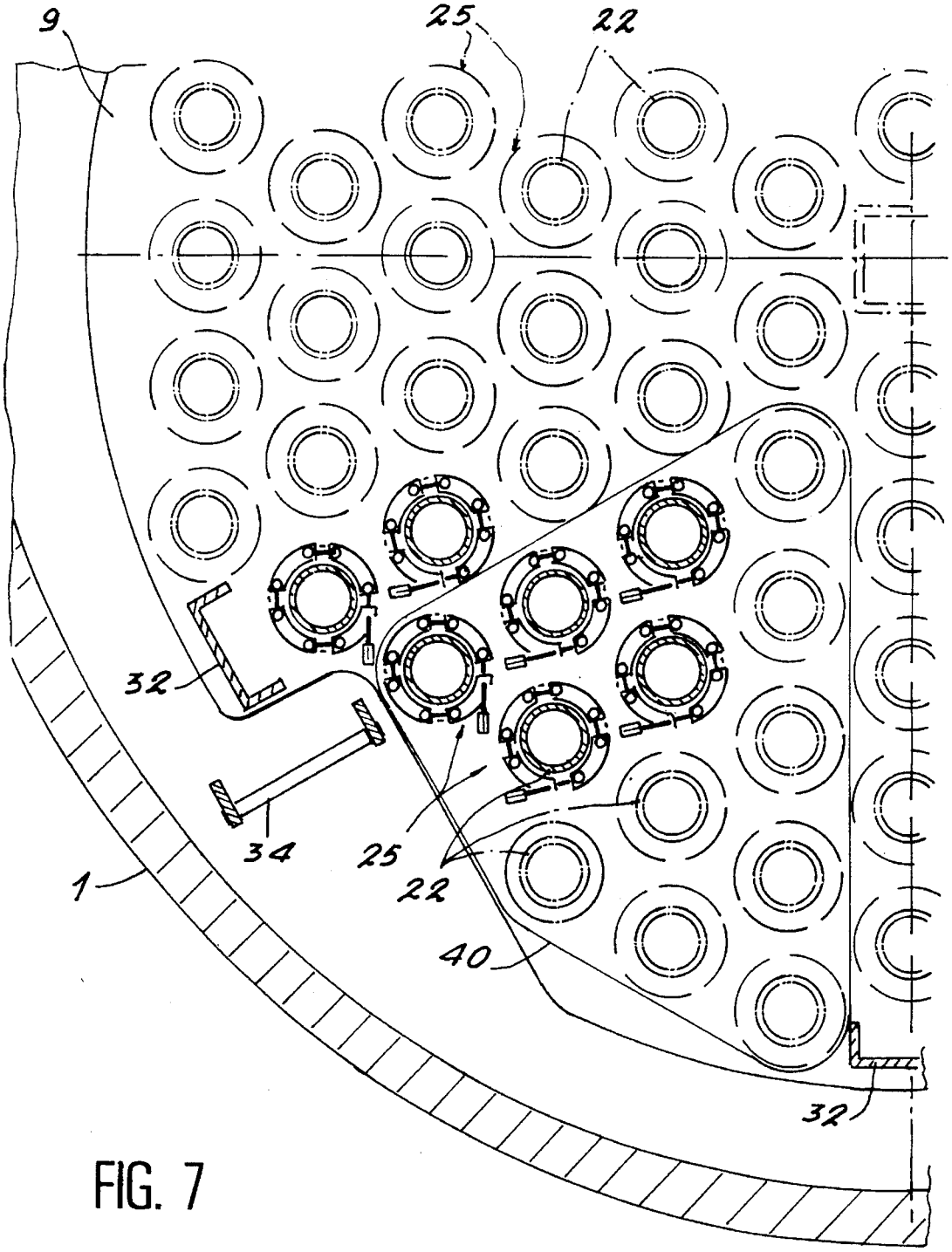
FIG. 7 is a plan view of part of the roof of the vaporization enclosure of the steam generator according to the invention.

FIG. 7 corresponds to section VII—VII of FIG. 4. Thus, it is possible to see the spacer tubes 22 in cross-section and the lower clamps 25 shown in greater detail elsewhere. The part of the vaporization enclosure roof 9 shown in FIG. 1 has a trapdoor 40 enabling personnel access to the interior of the enclosure. The trapdoor 40 in this embodiment supports twelve tubular column bases and has a surface area of approximately one square meter. It can be screwed to the roof 9.

Consequently, it is merely necessary to disassemble the twelve spacer tubes and optionally the cyclones, corresponding to the trapdoor 40, which is located on the border of the roof 9 and close to a ladder 34, in order to be able to remove the trap. A handling tool (block and tackle, arm) carried by the central mast makes it possible to raise the trap door.

As a result of the invention, it is possible to lower the mass of a spacer tube of less than 20 kg in order to permit manual handling. This is a very important advantage for disassembly, because it allows partial detachment.

During the disassembly of the first cyclone or cyclones, there may not be sufficient space to ensure their tilting with a view to their removal from the steam generator. In this case, the supporting structure can comprise a provisional cyclone storage area in order to leave sufficient free space at the location where tilting takes place.

The possibility of the manual handling of the spacer tubes allows the disassembly and reassembly thereof independently of that of the cyclones, which can then bear against the support grating. In this case, the spacer tubes are moved manually over the vaporization enclosure roof and in the areas of the ladders before being turned round and drawn out through the manholes. This makes it possible to dismantle the spacer tubes without extracting the cyclones, which can remain in position.

We claim:

1. Recirculation-type steam generator ensuring heat transfer between a primary fluid circulating in a primary circuit and a secondary fluid circulating in a secondary circuit, said steam generator comprising a pressure envelope containing a vaporization enclosure having a roof and covering a bundle of tubes traversed by said primary fluid, means permitting the introduction of said secondary fluid, circulation of said secondary fluid within said vaporization enclosure and extraction of steam produced by said secondary fluid during said circulation, drying means for said steam located between said roof and said steam extraction means, said drying means incorporating cyclone separators detachably fixed to said roof and constituted by cyclones fixed to first ends of tubular columns, second ends of said tubular columns being fixed to said roof communicating with said vaporization enclosure, each of said tubular columns comprising a base integral with said roof and a spacer tube having one end detachably fixed to said base, and another end fixed to at least one cyclone.

2. Recirculation-type steam generator ensuring heat transfer between a primary fluid circulating in a primary circuit and a secondary fluid circulating in a secondary circuit, said steam generator comprising a pressure envelope containing a vaporization enclosure having a roof and covering a bundle of tubes traversed by said primary fluid, means permitting the introduction of said secondary fluid, circulation of said secondary fluid within said vaporization enclosure and extraction of steam produced by said secondary fluid during said circulation, drying means for said steam located between said roof and said steam extraction means, said drying means incorporating cyclone separators detachably fixed to said roof by means of clamps and constituted by cyclones fixed to first ends of tubular columns, second ends of said tubular columns being fixed to said roof communicating with said vaporization enclosure.

3. Recirculation-type steam generator ensuring heat transfer between a primary fluid circulating in a primary circuit and a secondary fluid circulating in a secondary circuit, said steam generator comprising a pressure envelope containing a vaporization enclosure having a roof and covering a bundle of tubes traversed by said primary fluid, means permitting the introduction of said secondary fluid, circulation of said secondary fluid within said vaporization enclosure and extraction of steam produced by said secondary fluid during said circulation, drying means for said steam located between said roof and said steam extraction means, said drying means incorporating cyclone separators detachably fixed to said roof and constituted by cyclones fixed to first ends of tubular columns, second ends of said tubular columns being fixed to said roof communicating with said vaporization enclosure, said steam generator further comprising means for supporting said cyclone separators, said supporting means being fixed to said roof, and said supporting means and said cyclone separators having complementary elements permitting guidance of said cyclone separators during their installation.

4. Steam generator according to claim 3, wherein said supporting means comprise a ring and abutments permitting radial retention of said cyclone separator in said pressure envelope of said steam generator.

5. Recirculation-type steam generator ensuring heat transfer between a primary fluid circulating in a primary circuit and a secondary fluid circulating in a secondary circuit, said steam generator comprising a pressure envelope containing a vaporization enclosure having a roof and covering a bundle of tubes traversed by said primary fluid, means permitting the introduction of said secondary fluid, circulation of said secondary fluid within said vaporization enclosure and extraction of steam produced by said secondary fluid during said circulation, drying means for said steam located between said roof and said steam extraction means, said drying means incorporating cyclone separators detachably fixed to said roof and constituted by cyclones fixed to first ends of tubular columns, second ends of said tubular columns being fixed to said roof communicating with said vaporization enclosure, said steam generator further comprising means for supporting said cyclone separators, said supporting means being fixed to said roof, and including a reception mast for a cyclone separator handling tool.

6. Steam generator according to claim 1, wherein said cyclones are detachably fitted to said tubular columns.

7. Steam generator according to claim 1, wherein said roof comprises a trapdoor permitting the passage of personnel.

* * * * *